US008752402B1

(12) United States Patent
Pfaff

(10) Patent No.: US 8,752,402 B1
(45) Date of Patent: Jun. 17, 2014

(54) JEWELRY AND METHOD OF WEARING

(76) Inventor: Laura Pfaff, Milwaukee, WI (US)

( * ) Notice: Subject to any disclaimer, the term of this patent is extended or adjusted under 35 U.S.C. 154(b) by 65 days.

(21) Appl. No.: 13/471,240

(22) Filed: May 14, 2012

Related U.S. Application Data

(60) Provisional application No. 61/489,904, filed on May 25, 2011.

(51) Int. Cl.
*A44C 7/00* (2006.01)
*A45D 8/12* (2006.01)

(52) U.S. Cl.
USPC ..... 63/14.3; 63/12; D28/41; 132/275; 132/273; D11/78; D11/87; D11/88; 24/67.9; 24/547; 24/548; 24/549; 29/896.92; 29/896.93; 29/DIG. 30

(58) Field of Classification Search
None
See application file for complete search history.

(56) References Cited

U.S. PATENT DOCUMENTS

| | | | | |
|---|---|---|---|---|
| 2,033,943 | A * | 3/1936 | Lely | 63/20 |
| 2,629,989 | A * | 3/1953 | McDonald | 63/13 |
| 4,286,358 | A * | 9/1981 | Levin | 24/67 R |
| 4,733,544 | A * | 3/1988 | Londaro | 63/12 |
| 2005/0199003 | A1 | 9/2005 | Haraldsted et al. | |

OTHER PUBLICATIONS

Crystal Rhinestone Hair Screw Set of 5, retrieved May 2, 2011, www.annlesliedesigns.com/hd-4188-2c.html, 1 page.
Hair Screw Products from Alibaba.com, retrieved May 2, 2011, www.alibaba.com/product-gs/336331406/hair_screw.html, 2 pages.

* cited by examiner

*Primary Examiner* — Jack W. Lavinder
(74) *Attorney, Agent, or Firm* — Foley & Lardner LLP

(57) ABSTRACT

A jewelry item includes an ornament, a coil with a plurality of turns, and a pad. The pad includes a central bore configured for receiving the helical coil. A compressive force between adjacent turns of the helical coil couples the jewelry item to a body part. The jewelry item can be an earring.

20 Claims, 2 Drawing Sheets

JEWELRY AND METHOD OF WEARING

CROSS-REFERENCE TO RELATED APPLICATIONS

The present application claims the benefit of and priority to U.S. Provisional Application No. 61/489,904, filed on May 25, 2011, including the specification, drawings, claims and abstract, which is incorporated herein by reference in its entirety.

BACKGROUND

The present disclosure relates generally to the field of jewelry. More specifically, the disclosure relates to jewelry that can be attached to a body without piercing.

Jewelry including earrings have been worn for hundreds of years. Generally, earrings are attached to the ear by a post that extends through a piercing in the earlobe or other part of the ear. Other parts of the bodies may also be pierced to use similar jewelry. There are several disadvantages to piercings. The piercing process may be painful and results in a permanent holes in a person's ear. Further, piercings can become infected.

Jewelry can also be designed to attach to an ear or other body part by other means not requiring a pierced opening. Such clip-on jewelry generally relies on a clamp or other mechanism such as one or more magnets to secure the jewelry to the body. Magnets and clamps can be uncomfortable to wear or can be susceptible to disengaging from the ear.

Thus, there is a need for a comfortable means of wearing jewelry. Further, there is a need for a stable coupling for jewelry that does not require piercing, clamps or magnets. Further still, there is a need for a coupling for an earring that does not uncomfortably pinch the earlobe.

SUMMARY

One embodiment of the disclosure relates to a jewelry item. The jewelry item includes an ornament, a helical coil with a plurality of turns, and a pad. The pad includes a central bore configured for receiving the helical coil. A compressive force between adjacent turns of the helical coil couples the jewelry item to a body part.

Another embodiment of the disclosure relates to an earring. The earring includes an ornament, a helical coil with a plurality of turns, and a pad. The pad includes a central bore configured for receiving the helical coil. A compressive force between adjacent turns of the helical coil couples the earring to an ear.

Still another embodiment of the disclosure relates to a jewelry item. The jewelry item includes an ornament, and a helical coil with a plurality of turns. A compressive force between adjacent turns of the helical coil couples the jewelry item to a body part.

Yet another embodiment relates to a method of manufacturing an earring. The method includes attaching an ornamental piece to a coil, and providing a member around a segment of the coil. The member is a different material than the coil. The member has a greater coefficient of sliding friction than material of the coil.

Yet another embodiment relates to a method of wearing an earring. The method includes twisting a coil of the earring onto an earlobe. The earlobe is disposed between two adjacent rings of the coil. A pad having a higher coefficient of sliding friction with respect to skin can be disposed on one or more of the adjacent rings. In one preferred embodiment, the earring can be held onto the earlobe stably without excessive squeezing, pinching or discomfort.

According to another embodiment, an earring including a coil can be provided in a package including instructions. The instructions can describe the engagement of an earlobe to the coil.

It is to be understood that both the foregoing general description and the following detailed description are illustrative and explanatory only, and are not restrictive of the invention as claimed.

BRIEF DESCRIPTION OF THE DRAWINGS

These and other features, aspects, and advantages of the present invention will become apparent from the following description, appended claims, and the accompanying illustrative embodiments shown in the drawings, which are briefly described below.

DETAILED DESCRIPTION OF THE PREFERRED EMBODIMENTS

Figure 1:
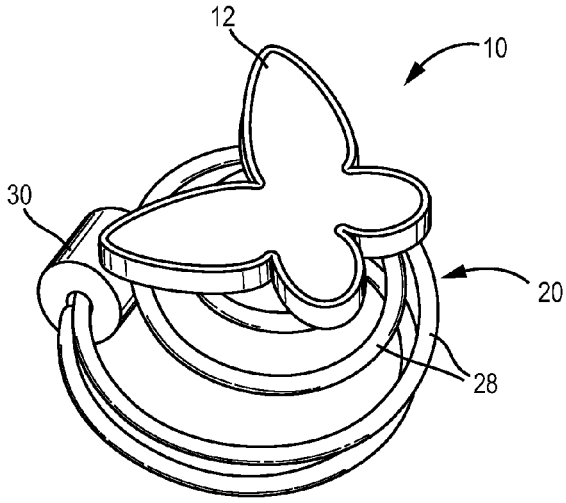
FIG. 1 is a perspective view of an earring, according to an exemplary embodiment.
Figure 2:
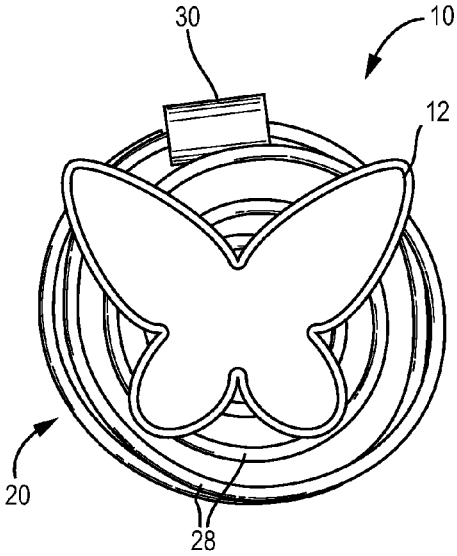
FIG. 2 is a top view of the earring of FIG. 1.
Figure 3:
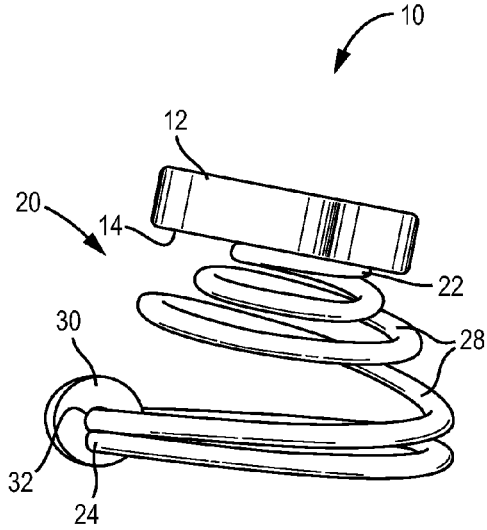
FIG. 3 is a side view of the earring of FIG. 1.

Referring to FIGS. 1-3, jewelry item, such as, an earring 10 is shown according to an exemplary embodiment. Earring 10 is configured to be coupled to a portion of the ear, such as the earlobe 40 (see FIGS. 4-5) without the use of a pierced hole in the ear. While earring 10 will be described as a piece of jewelry for the ear, a similar jewelry item may be configured to adorn another part of the body, such as the lip, or the nose. Earring 10 includes an ornament 12 (e.g., decorative element, etc.), a coil 20, and a pad 30 (e.g., plug, insert, etc.).

Ornament 12 includes one or more decorative elements that are displayed when earring 10 is coupled to a body part. Ornament 12 may be a single body, as shown in the FIGURES, or may include multiple elements (e.g., interlocking loops, chains, strands, etc.). Ornament 12 can be any shape or size and is not shown in a limiting fashion. Ornament 12 can include gemstones, figures, or any ornamental feature. Ornamental features can also be provided on coil 20.

Referring to FIG. 3, coil 20 extends from a first end 22 coupled to the rear side 14 of ornament 12 to a distal second end 24. First end 22 of coil 20 may be coupled to ornament 12 with any appropriate coupling method such as with adhesive, with a mechanical fastener, by welding, or by soldering. Coil 20 serves as a coupling element for earring 10.

Coil 20 is preferably a helical coil that is formed by curling an elongated element in a series of turns 28. According to an exemplary embodiment, coil 20 is formed from a metal wire. In other exemplary embodiment, coil 20 may be formed of a polymer (e.g., plastic, rubber and similar materials) or other material with a suitable elasticity. Coil 20 preferably is malleable. While the elongated element forming coil 20 is shown in the FIGURES as having a circular cross-section, coil 20 may be formed from an elongated element having an otherwise shaped cross-section (e.g., square, rectangular, hexagonal, elliptical, oval, etc.) in other exemplary embodiments.

In one embodiment, coil 20 has an elasticity that allows earring 10 to be attached to earlobe 40 without significant discomfort or painful pinching and yet secures earring 10 to earlobe 40 during normal use. Preferably, a compressive force imparted between adjacent rings or turns 28 of coil 20 hold earring into earlobe 40.

In a preferred embodiment, coil 20 can have the material and elasticity of coils associated with the coils of hair screw jewelry or twist-in-hair jewelry. In one embodiment, coil 20 can be a copper base metal that is coated for comfort. Coil 20 can also be or include gold, silver, aluminum, nylon, plastic, brass, nickel, or any suitable material for engaging earlobe 40.

The element that makes up coil 20 can be round in cross section and be less than 1/16 of an inch in diameter (e.g., 1/24, 1/32, 3/64, 3/128, etc. of an inch) in one embodiment. In other embodiments, the element can be more than 1/8 of an inch in diameter or less than 1/24 an inch in diameter. The dimensions provided above are exemplary only and not disclosed in a limiting fashion.

Coil 20 can have a first ring or turn 28 approximately 0.5 inches in diameter with successive rings or turns 28 smaller in diameter according to one embodiment. First turn 28 can have a sphere or other stop at its end 24 according to one embodiment. A distance from the first turn 28 and the last turn 28 (i.e., end 22-turn 28 attached to ornament 12) can be approximately 3/8 inches in a longitudinal direction through the center points of the turns 28 of coil 20 in one embodiment. Coil 20 can have turns 28 with a variety of sizes depending materials, sizes of earlobe 40, desired elasticity, etc. Larger and smaller dimensions for coil 20, turns 28 and the element associated with coil 20 are possible. The dimensions provided above are exemplary only and not disclosed in a limiting fashion.

Pad 30 is a generally cylindrical member with a central bore 32 that is sized to receive the elongated member forming coil 20. Pad 30 is coupled to coil 20 by feeding second end 24 into bore 32 and moving pad 30 along the length of coil 20. Pad 30 may be formed from a resilient material, such as an elastomer (e.g., polymer, plastic, rubber, etc.), or may be formed from a rigid material, such as a metal, glass, paper, or a ceramic. Pad 30 can also be a foam material. Pad 30 can be latex free according to one embodiment. Pad 30 can be clear or colored.

Pad 30 can be formed by dipping coil 20 or otherwise coated on coil 20. Pad 30 is configured to be able to move along the length of coil 20. Bore 32 may therefore have a diameter greater than the diameter of the elongated member forming coil 20 to compensate for the diameter of turns 28 and/or pad 30 may flex to compensate for the diameter of turns 28. According to an exemplary embodiment, bore 32 may be centrally located along the longitudinal axis of pad 30. In other exemplary embodiments, bore 32 may be offset from the longitudinal axis of pad 30. In other exemplary embodiments, pad 30 may have a slit or cut from the outside surface to bore 32 to allow pad to be slid or clipped onto coil 20 anywhere along the length of coil 20 instead of being fed onto coil 20 at second end 24.

Pad 30 preferably has a greater diameter than the element associated with coil 20 (e.g., 3/16-3/8 of an inch). Pad 20 can have a wall thickness of approximately 1/16 of an inch in one embodiment. The member for coil 20 can be provided with pad 30 attached by the manufacturer.

In a preferred embodiment, pad 30 has a coefficient of sliding friction with respect to skin that is relatively high so that earring 10 is less likely to slide from earlobe 40. Preferably, pad 30 has a higher coefficient of sliding friction with respect to skin that is greater than the material of coil 20.

Pad 30 can be short (e.g., 1/8 of an inch in length) or cover 90 percent of the circumference of the first turn 28 associated with coil 20. In other alternatives, pad 30 can cover more than one turn 28 of coil 20. In one alternative embodiment, pad 30 covers two adjacent turns 28 of coil 20 and earlobe 40 is placed between the two padded rings 28.

In one embodiment, two pads 30 are provided; one on each of two adjacent rings of coil 20. Alternatively, pad 20 can be a non-cylindrical clip having a C-shaped cross-section for engaging coil 20. Pad 20 can also have a square shaped or rectangular shaped cross sectional area. The dimensions provided for pad 20 are exemplary. Other dimensions for pad 20 are possible without departing from the scope of the invention.

Figure 4:
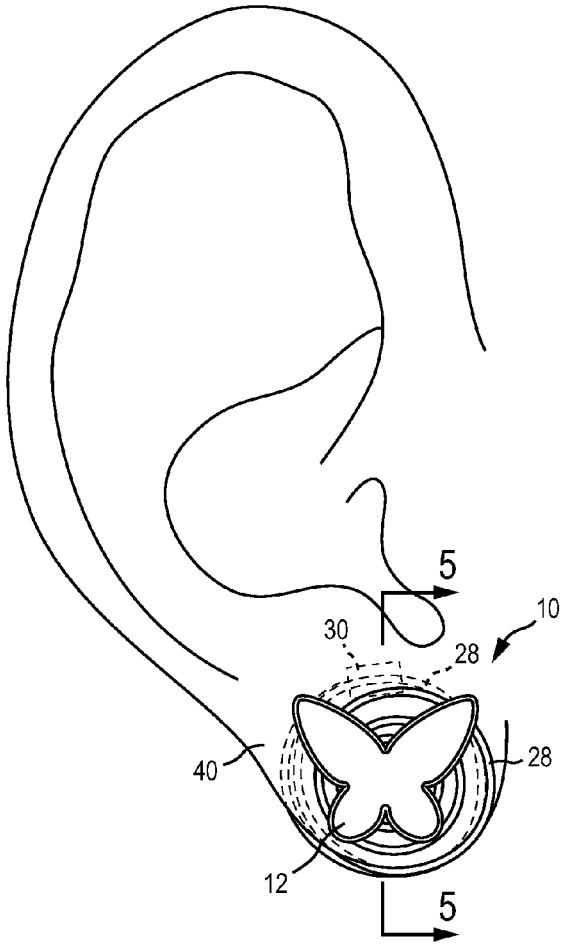
FIG. 4 is a perspective view of the earring of FIG. 1 coupled to an ear lobe, according to an exemplary embodiment.
Figure 5:
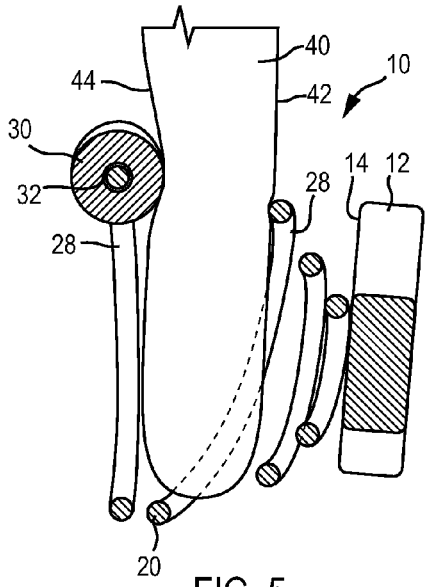
FIG. 5 is a cross-section of the earring and ear lobe of FIG. 4, taken along line 5-5.

Referring to FIGS. 4-5, earring 10 may be coupled to an earlobe 40 by inserting earlobe 40 between adjacent turns 28 of coil 20. In one embodiment, coil 20 forms a tension or extension spring. As earlobe 40 is inserted between turns 28 of coil 20, turns 28 are pushed away from their rest positions, resulting in a compressive force applied to the first side 42 and the second side 44 of earlobe 40 and thereby coupling earring 10 to earlobe 40.

According to an exemplary embodiment, the diameter of the turns 28 and the distance between adjacent turns 28 increases as the distance from the ornament 12 increases (with the exception of the last turn 28 which includes at least a portion that is directly adjacent to the remaining turn 28 in one embodiment). The variable diameter of turns 28 of coil 20 provides a variable tensile force between adjacent turns 28. In this way, the force applied to earlobe 40 may be adjusted by inserting earlobe 40 into coil 20 closer to ornament 12.

Advantageously, coil 20 allows earring 10 to be attached according to a twist-on motion. This allows gradual tension to be exerted against earlobe 40 so that the wearer can appropriately attach earring 10 to earlobe 40 without uncomfortable squeezing or pinching. The twist-on motion involves turning earring 10 to engage ear lobe 40. A 1/4 (quarter) to 1/2 (half) turn is generally satisfactory, although other size turns are possible. Generally, the greater the turn, the tighter the attachment to earlobe 40 depending on material types, coil sizes, earlobe size, etc.

Pad 30 contacts earlobe 40 when earlobe 40 is inserted between adjacent turns 28 of coil 20. Pad 30 may be positioned along coil 20 to contact first side 42 or second side 44 of earlobe 40. Pad 30 provides a localized area of increased pressure to facilitate the coupling of earring 10 to earlobe 40. In other exemplary embodiments, pad 30 may not be utilized. In still other exemplary embodiments, more than one pad 30 may be utilized (e.g., a pad 30 may be provided on either side of earlobe for both first side 42 and second side 44, etc.).

It should be understood that variations of earring 10 may be configured to provide different aesthetic effects, to be coupled to other body parts, or to be more effectively coupled to other parts of the ear (e.g., the tragus, the helix, etc.). For instance, coil 20 may be configured with a larger or smaller space between adjacent turns 28 to better accommodate thicker or thinner body parts. The space between adjacent turns 28 used to engage earlobe 40 can vary from 0 to 1/8 of an inch in one embodiment. In other embodiments, the space can be from 0 to 3/8 of an inch or from 0 to 1/2 of an inch depending on body part sizes.

In other embodiments, the diameter of the turns 28 may decrease as the distance from the ornament 12 increases so that larger, more prominent turns 28 are visible on the side of the body part with ornament 12. In other embodiments, turns 28 may not be circular and may be otherwise contoured or shaped (e.g., square-shaped, egg-shaped, elliptical, oval, etc.).

In one embodiment, earring 10 can be embodied as a twist-in-hair jewelry or hair screw jewelry and packaged as an earring. The hair screw jewelry can include directions for attaching the jewelry to earlobe 40 in accordance with this disclosure. The directions can state: place coil 20 next to ear lobe 40 and engage earlobe 40 between adjacent ring turns 28 of coil 20. The directions can also note that ear lobe 40 can be engaged with a twist motion until a suitable, yet comfortable compressive force is applied to earlobe 40. Alternatively, a more linear motion can be used to engage earlobe 40. The directions for engagement can also include widening the distance between adjacent rings or turns 28 if necessary by gently pulling on rings or turns 28 and narrowing the distance between adjacent turns or rings 28 if necessary by gently squeezing turns or rings 28 together.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is important to note that the construction and arrangement of the earring as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages presented in the present application. Accordingly, all such modifications are intended to be included within the scope of the present disclosure. Other substitutions, modifications, changes and omissions may be made in the design, operating conditions and arrangement of the various exemplary embodiments without departing from the scope of the present disclosure.

What is claimed is:

1. An earring jewelry item, comprising:

a pad;

an ornamental piece; and a wire having a first end and a second end and a plurality of turns between the first end and the second end, the wire configured in a conical helix shape, wherein the wire is attached to the ornamental piece at a top of the conical helix shape, the top terminating at the first end and wherein the ornamental piece at least partially hides a first turn of the turns and completely overlaps the first end, wherein the conical helix shape provides utility to a user by providing a larger diameter turn of the turns at a bottom of the conical helix shape for more easily attaching the jewelry item to a body part between two of the turns, the bottom terminating at the second end, wherein the pad comprises a central bore configured for receiving the second end of the wire, wherein the pad is positionable along a second turn of the turns, wherein the pad is a cylindrical element.

2. The jewelry item of claim 1, wherein a gap between a first portion of the second turn and a second portion of a third turn can be increased by gently pulling the first turn from the third turn.

3. The jewelry item of claim 1, wherein the wire is formed of one of a metal wire or a polymer wire.

4. The jewelry item of claim 1, wherein a compressive force between adjacent turns of the conical helix shape couples the jewelry item to the body part.

5. The jewelry item of claim 1, wherein the cylindrical element is an elastomer.

6. The jewelry item of claim 1, wherein the jewelry item is configured to be coupled to a lobe of an ear.

7. An earring, comprising:

a member;

an ornamental piece; and a helical coil coupled to the ornamental piece, the helical coil comprising a wire configured in a conical helix shape and having a plurality of turns between a first end of the wire and a second end of the wire, wherein a first turn of the turns has a first diameter less than a second diameter of a second turn of the turns, the first turn being adjacent the second turn on a first side of the second turn, wherein the second diameter is less than a third diameter, wherein a third turn has the third diameter and is adjacent the second turn on a second side of the second turn, the second side being opposite the first side, wherein the ornamental piece is closer to the first turn than the third turn, wherein the ornamental piece covers the first end, the member being a different material than the wire and having a greater coefficient of sliding friction than material of the wire, the member being disposed around a segment of the wire;

whereby a compressive force at a location of the member between at least two of the first turn, the second turn, and the third turn of the helical coil couples the earring to an ear.

8. The earring of claim 7, wherein the first end is at a top of the conical helix shape.

9. The earring of claim 7, wherein the member is disposed on the third turn.

10. The earring of claim 8, wherein the ear is disposed between the member and the second turn when the earring is worn.

11. The earring of claim 10, wherein the member is positioned to abut against the second end of the wire.

12. A method of manufacturing an earring, comprising:

attaching an ornamental piece to a coil, wherein the coil is configured as a conical helix, wherein the conical helix comprises a wire having a plurality of turns between a first end of the wire and a second end of the wire, wherein a first turn of the turns has a first diameter less than a second diameter, wherein a second turn of the turns has the second diameter, wherein the first turn is attached to the ornament piece and wherein the second turn is configured to attach to an ear lobe by rotating the conical helix onto the ear lobe to provide a compressive force between the second turn and a neighboring turn, wherein the ornamental piece overlaps the first end of the wire; and providing a member around a segment of the coil, the member being a different material than the coil, the member having a greater coefficient of sliding friction than material of the coil.

13. The method of claim 12, wherein the member abuts against an end of the coil and has a bore, the coil being inserted into the bore.

14. The method of claim 13, wherein the wire of the coil is formed of at least one of a metal wire or a polymer wire.

15. The method of claim 12, wherein the member is a cylindrical pad.

16. The method of claim 15, wherein a distance between adjacent turns of the coil increases as a distance from the ornamental piece along the coil increases.

17. The method of claim 15, wherein the member is a pad positioned on the neighboring turn of the coil proximate to the ear when the earring is worn.

18. The method of claim 17, wherein the pad covers more than 90 percent of the neighboring turn of the coil.

19. The method of claim 15, wherein a circumference of the coil at a bottom of the coil is larger than a circumference of the coil at a top of the coil, wherein the ornamental piece is attached to the top of the coil.

20. The method of claim 15, wherein an elasticity of the coil is chosen so that the earring is maintained on the ear lobe during normal use without uncomfortable pinching.

* * * * *